US005215627A

United States Patent [19]

Willis et al.

[11] Patent Number: 5,215,627

[45] Date of Patent: Jun. 1, 1993

[54] METHOD OF MAKING A WATER LAID FIBROUS WEB CONTAINING ONE OR MORE FINE POWDERS

[75] Inventors: Anthony J. Willis, Marlow; Bronislaw Radvan, Flackwell Heath, both of England

[73] Assignee: The Wiggins Teape Group Limited, Basingstoke, England

[21] Appl. No.: 912,668

[22] Filed: Jul. 14, 1992

Related U.S. Application Data

[63] Continuation of Ser. No. 309,016, Feb. 9, 1989, abandoned, which is a continuation of Ser. No. 77,910, Jul. 27, 1987, abandoned.

[30] Foreign Application Priority Data

Jul. 31, 1986 [GB] United Kingdom ..... 8618733

[51] Int. Cl.[5] ..... D06M 23/00

[52] U.S. Cl. ..... 162/156; 162/160; 162/162; 162/164.1; 162/181.4; 162/181.9; 162/183; 428/283; 428/297

[58] Field of Search ..... 162/181.4, 181.9, 182, 162/183, 145, 146, 181.1, 181.5, 181.6, 164.1, 168.1, 169, 10, 12, 13, 162, 156; 428/283, 297, 327

[56] References Cited

U.S. PATENT DOCUMENTS

| | | | |
|---|---|---|---|
| 1,875,018 | 8/1932 | Kliefoth | 162/183 X |
| 1,901,382 | 3/1933 | Stevenson | 162/183 X |
| 2,388,187 | 10/1945 | Sallé | 162/164.1 X |
| 2,653,870 | 9/1953 | Kast . | |
| 2,715,755 | 8/1955 | Jones | 19/156 |
| 2,795,524 | 6/1957 | Rodman . | |
| 2,892,107 | 6/1959 | Williams et al. . | |
| 2,962,414 | 11/1960 | Arledter . | |
| 3,200,181 | 8/1965 | Rudloff | 264/109 |
| 3,205,085 | 9/1965 | Bailin . | |
| 3,216,841 | 11/1965 | Thellmann . | |
| 3,396,062 | 8/1968 | White . | |
| 3,428,518 | 2/1969 | Schafer | 161/170 |
| 3,452,128 | 6/1969 | Rains . | |
| 3,489,827 | 1/1970 | Mueller et al. . | |
| 3,494,824 | 2/1970 | Roberts . | |
| 3,573,158 | 3/1971 | Pall et al. . | |
| 3,607,500 | 9/1971 | Field . | |
| 3,621,092 | 11/1971 | Hofer | 264/322 |
| 3,734,985 | 5/1973 | Greenberg | 264/45 |
| 3,832,115 | 8/1974 | Ettel . | |
| 3,837,986 | 9/1974 | Gorter et al. | 161/59 |
| 3,850,723 | 11/1974 | Ackley . | |

(List continued on next page.)

FOREIGN PATENT DOCUMENTS

| | | |
|---|---|---|
| 230504 | 1/1958 | Australia . |
| 559853 | 7/1983 | Australia . |
| 0071219 | 2/1983 | European Pat. Off. . |
| 0148760 | 7/1985 | European Pat. Off. . |

(List continued on next page.)

OTHER PUBLICATIONS

*Webster's New World Dictionary of the American Language*, Second College Edition, The World Publishing Co., New York & Cleveland.

1004 Abstracts Bulletin of the Institute of Paper Chemistry, vol. 55 (1982) Aug., No. 2, Appleton, Wisc., USA.

"Polymer Processing", James M. McKelvey, 1962.

"Paints and Varnishes-Determination of flow time by use of flow cups", International Standard ISO 2431, 1984.

"Part A6, Determination of flow time by use of flow cups", British Standards Institution, 1984.

"Fibre Foam", Turner & Cogswell, 1976, presented at VIIth International Congress on Rheology in Sweden, Aug. 23-Aug. 27, 1976.

*Primary Examiner*—Thi Dang

*Attorney, Agent, or Firm*—Burns, Doane, Swecker & Mathis

[57] ABSTRACT

A method of making a fibrous web containing at least two particulate materials and which includes mixing the dry particulate materials together in a substantially dry condition, using the dry mix to form at least part of an aqueous dispersion of fibres, and draining the dispersion to form a web.

9 Claims, 1 Drawing Sheet

U.S. PATENT DOCUMENTS

| | | | |
|---|---|---|---|
| 3,856,614 | 12/1974 | Suski et al. . | |
| 3,865,661 | 2/1975 | Hata et al. | 156/79 |
| 3,873,336 | 3/1975 | Lambert et al. | 162/181.2 X |
| 3,891,738 | 6/1975 | Shen | 264/101 |
| 3,897,533 | 7/1975 | Hani et al. | 264/137 |
| 3,903,343 | 9/1975 | Pfaff . | |
| 3,930,917 | 1/1976 | Esakov et al. . | |
| 3,975,483 | 8/1976 | Rudloff | 264/137 |
| 3,980,511 | 9/1976 | Proucelle . | |
| 3,980,613 | 9/1976 | Bachot et al. . | |
| 4,007,083 | 2/1977 | Ring et al. . | |
| 4,081,318 | 3/1978 | Wietsma . | |
| 4,104,340 | 8/1978 | Ward | 264/6 |
| 4,104,435 | 8/1978 | Ballesteros . | |
| 4,153,760 | 5/1979 | Sundberg et al. . | |
| 4,159,294 | 6/1979 | Osihi et al. . | |
| 4,178,411 | 12/1979 | Cole et al. | 428/310 |
| 4,234,652 | 11/1980 | Vanoni et al. | 428/296 |
| 4,242,404 | 12/1980 | Bondoc et al. | 428/220 |
| 4,273,981 | 6/1981 | Nopper | 219/10.49 |
| 4,286,977 | 9/1981 | Klein . | |
| 4,327,164 | 4/1982 | Feinberg et al. . | |
| 4,339,490 | 7/1982 | Yoshioka et al. . | |
| 4,359,132 | 11/1982 | Parker et al. . | |
| 4,362,778 | 12/1982 | Andersson et al. | 428/240 |
| 4,386,943 | 6/1983 | Gumbel et al. | 51/298 |
| 4,393,154 | 7/1983 | Tyler et al. . | |
| 4,399,085 | 8/1983 | Belbin et al. | 264/41 |
| 4,426,470 | 1/1984 | Wessling et al. | 524/35 |
| 4,440,819 | 4/1984 | Rosser et al. | 428/107 |
| 4,451,539 | 5/1984 | Vallee et al. . | |
| 4,469,543 | 9/1984 | Segal et al. . | |
| 4,481,248 | 11/1984 | Fraige . | |
| 4,495,238 | 1/1985 | Adiletta | 428/215 |
| 4,498,957 | 2/1985 | Sasaki | 162/146 |
| 4,503,116 | 3/1985 | Lapidus . | |
| 4,508,777 | 4/1985 | Yamamoto et al. | 428/280 |
| 4,512,836 | 4/1985 | Tucci | 156/174 |
| 4,543,288 | 9/1985 | Radvan et al. | 428/297 |
| 4,562,033 | 12/1985 | Johnson et al. | 264/510 |
| 4,568,581 | 2/1986 | Peoples, Jr. . | |
| 4,595,617 | 6/1986 | Bogdany . | |
| 4,643,940 | 2/1987 | Shaw et al. . | |
| 4,649,014 | 3/1987 | Tochikawa . | |
| 4,659,528 | 4/1987 | Plowman et al. . | |
| 4,663,225 | 5/1987 | Farley et al. . | |
| 4,670,331 | 6/1987 | Radvan et al. | 428/303 |
| 4,690,860 | 9/1987 | Radvan et al. . | |
| 4,719,039 | 1/1988 | Leonardi . | |
| 4,734,321 | 3/1988 | Radvan et al. . | |

FOREIGN PATENT DOCUMENTS

| | | |
|---|---|---|
| 0152994 | 8/1985 | European Pat. Off. . |
| 0173382 | 3/1986 | European Pat. Off. . |
| 1504828 | 4/1969 | Fed. Rep. of Germany . |
| 3420195 | 12/1985 | Fed. Rep. of Germany . |
| 1040359 | 10/1953 | France . |
| 56-37373 | 4/1981 | Japan . |
| 462024 | 10/1968 | Switzerland . |
| 448138 | 12/1934 | United Kingdom . |
| 703023 | 1/1954 | United Kingdom . |
| 729381 | 5/1955 | United Kingdom . |
| 843154 | 8/1960 | United Kingdom . |
| 855132 | 11/1960 | United Kingdom . |
| 871117 | 6/1961 | United Kingdom . |
| 1008833 | 11/1965 | United Kingdom . |
| 1058932 | 2/1967 | United Kingdom . |
| 1110659 | 4/1968 | United Kingdom . |
| 1113792 | 5/1968 | United Kingdom . |
| 1129757 | 10/1968 | United Kingdom . |
| 1134785 | 11/1968 | United Kingdom . |
| 1198324 | 7/1970 | United Kingdom . |
| 1204039 | 9/1970 | United Kingdom . |
| 1230789 | 5/1971 | United Kingdom . |
| 1231937 | 5/1971 | United Kingdom . |
| 1263812 | 2/1972 | United Kingdom . |
| 1305982 | 2/1973 | United Kingdom . |
| 1306145 | 2/1973 | United Kingdom . |
| 1329409 | 9/1973 | United Kingdom . |
| 1330485 | 9/1973 | United Kingdom . |
| 1348896 | 3/1974 | United Kingdom . |
| 1412642 | 11/1975 | United Kingdom . |
| 1424682 | 2/1976 | United Kingdom . |
| 2051170 | 1/1981 | United Kingdom . |
| 2093474 | 9/1982 | United Kingdom . |
| 2096195 | 10/1982 | United Kingdom . |
| 2065016 | 2/1983 | United Kingdom . |

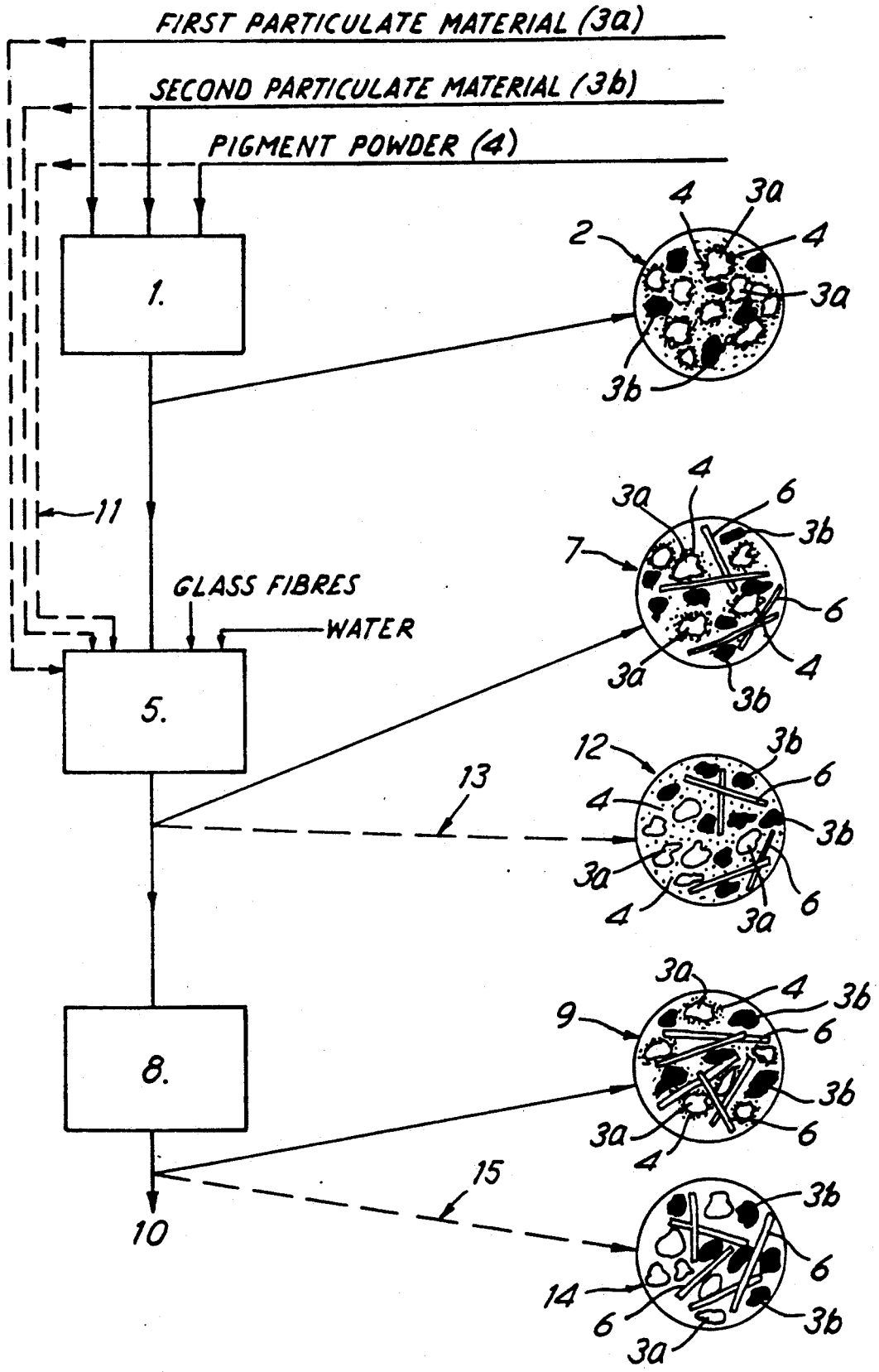
FIRST PARTICULATE MATERIAL (3a)
SECOND PARTICULATE MATERIAL (3b)
PIGMENT POWDER (4)
1.
2
4
3a
3b
11
GLASS FIBRES
WATER
5.
7
6
12
13
8.
9
10
14
15

METHOD OF MAKING A WATER LAID FIBROUS WEB CONTAINING ONE OR MORE FINE POWDERS

This application is a divisional of application Ser. No. 07/309,016, filed Feb. 9, 1989 now abandoned which is a continuation of application Ser. No. 07/077,910, filed Jul. 27, 1987, now abandoned.

BACKGROUND OF THE INVENTION

This invention relates to a method of making a water laid fibrous web such as a paper web or a web of plastics material and reinforcing fibres for consolidation or moulding into a fibre reinforced plastics sheet or article.

In paper webs, it is frequently necessary to incorporate particulate materials or powders such as pigments and fillers. In the case of webs of plastics material and reinforcing fibres one or more kinds of particulate plastics material may be included, together with materials such as pigments, fillers and antioxidants in the form of powders of substantially smaller particle size than the plastics material.

The process for making such water laid webs requires as a prerequisite the formation of an aqueous dispersion of the fibres and particulate materials from which the web is to be formed. Preferably, a foamed dispersion is used as described in the Applicants' co-pending European Application No. 85300031.3 (European Patent Publication No. 0 148 760), the subject matter of that Application being incorporated by reference herein. The dispersion so formed is then drained on a foraminous support such as the Fourdrinier wire of a paper machine, to form the web.

Two problems arise in the mechanism of more than one particulate material in an aqueous or foamed dispersion as referred to above.

First, the electrochemical conditions within such dispersions make it difficult to achieve a homogeneous mixture of the various components within the dispersion, and this is reflected as a lack of homogeneity in the web as laid down on the foraminous support.

Secondly, there will be a tendency for the particulate material to be lost during the wet laying process depending on the relative dimensions of the powder particles and the apertures in the foraminous element, for example the mesh size of a Fourdrinier wire.

When certain particles or fibres are dispersed in water, it is thought that an aqueous film forms around each individual particle or fibre and sets up an electro-chemical regime such that other particles are repelled. As a result, when fine powders are added individually, they do not agglomerate either with themselves or with other solid components of the dispersion. Thus, when the dispersion is laid down on the Fourdrinier wire, the fine particles pass through the wire with the water as drainage.

SUMMARY OF THE INVENTION

The invention is particularly concerned with a technique which will improve the homogeneity of the dispersion and resulting sheet, and which, where larger and smaller particles need to be incorporated in the sheet, will increase the retention of the smaller particles where the relative mesh size is such that they would otherwise be substantially lost in drainage through the foraminous element.

According to the present invention a method of making a fibrous web containing at least two particulate materials includes mixing the particulate materials together in a substantially dry condition, using the dry mix to form at least part of an aqueous dispersion of fibres, and draining the dispersion to form a web.

Thus, if a fibrous reinforced plastics material web is being made, the particulate materials can be a mixture of particulate thermoplastics. Alternatively a thermoplastic or a thermosetting polymer, can be mixed with a fine powder such as carbon black or titanium dioxide, the dry mix being dispersed in an aqueous dispersion of fibres prior to drainage to form a web. The fibres may, for example, be glass fibres.

The method of the invention is suitable for use with the process for forming a fibrous web set forth in the Applicants' co-pending European Application No. 85300031.3 (European Publication No. 0 148 760) the subject matter of that Application being incorporated by reference herein.

Again, the invention can be employed in the manufacture of a web in which the particulate material is a fibre, the dry mix being used to form an aqueous dispersion of fibres and drained to form a web.

The method can also be employed where two or more different fibres are to be incorporated in a web, with one or more of the fibres acting as the particulate material which is dry pre-mixed with the dry fine powder before an aqueous dispersion is formed.

It has been found that when mixed dry the homogeneity of the web is improved. Also, it has been found that dry mixing causes fine powder to adhere to substantially coarser particulate material such as thermoplastic, and that this adhesion persists when the dry mix becomes part of or forms the aqueous dispersion. Since the fine powder thus becomes part of a substantially larger agglomerated component of the dispersion, it is retained in the web.

It has also been found that the invention provides a successful method of incorporating a fine pigment powder in the web so as to effect a very uniform coloration of mouldings produced using the fibrous web produced by the process, although other fine powders for other purposes such as antioxidants can of course be employed alternatively or in addition to pigments.

It will be appreciated that the method can also be employed in the manufacture of paper to enhance the retention of powdered additives.

The fine powder and particulate materials can conveniently be pre-mixed in mixers are of the high shear type.

BRIEF DESCRIPTION OF THE DRAWING

The invention can be performed in various ways and one embodiment will now be described by way of example and with reference to the accompanying flow chart, which shows the benefits of the present invention by comparison with known technology.

DESCRIPTION OF THE PREFERRED EMBODIMENTS

The flow chart relates to the production of a foamed aqueous dispersion for use in the manufacture of a pigmented web of reinforcing fibre and particulate plastics material as described and claimed in European Patent Application 85300031.3 (Publication No. 0 148 760).

The technique shown may be used for the production of dispersions of two or more particulate plastics materials so as to achieve a homogeneous mixture of one or more particulate materials with much finer powders of, for example, pigments or antioxidants so as to achieve both homogeneity and retention of the powder during the wet web laying process.

However to illustrate the invention in a comprehensive manner the flow chart shows the technique of the invention as used for mixing two particulate polymers of relatively coarse particle size, for example, 100 to 500 microns, with a pigment having a particle size of, for example, 10 to 100 microns.

As shown in solid lines in the flow chart, the two particulate plastics materials and the pigment are first charged into a high shear powder blender 1, for example a Winkworth Ribbon Refiner Batch Mixer, a Gloucester Materials Handling High Shear Batch Blender or a Continuous Gerick E Blender (Powteck Type GAL-351). Microdiagram 2 shows that after blending the two particulate plastics materials 3*a* and 3*b* are evenly mixed and that they are both coated with the pigment 4.

The pigment coated particles 3*a* and 3*b* are transferred to a hydropulper 5 in which a foamed aqueous dispersion of glass fibres 6 has previously been formed. Because of the homogeneous mixing which has previously taken place in the mixer 1, the homogeneity of the dispersion of fibres and particles thus formed in the hydropulper 5 is assured. Furthermore, substantially all of the powdered pigment 4 continues to adhere to the larger polymeric particles 3*a* and 3*b*, as best seen in microdiagram 7.

The foamed aqueous dispersion formed in the hydropulper 5 is then used in the formation of a wet laid web in the process 8 which is carried out according to the process described in the aforementioned European Patent Application. The resulting web comprises well distributed glass fibres and polymeric particles, with the polymeric particles still retaining adherent pigments as best seen in microdiagram 9.

The formed web is then passed to drying, pressing and moulding stages 10 as required, which do not form part of this invention.

If the two particulate polymers 3*a* and 3*b* and the pigment 4 are added directly to the hydropulper 5 as indicated by the broken lines 11 and not premixed in a substantially dry state in the mixer 1, it is more difficult to achieve homogeneous mixing with the fibres 6 in the dispersion. Furthermore, the powdered pigment becomes dispersed as individual particles in the foamed dispersion, as best seen in microdiagram 12. As a result they tend to be lost in drainage during the wet laying process, so that few or none remain in the formed web, as shown in microdiagram 14.

It will be appreciated that the materials which can be premixed as described are not limited to particulate polymers or pigments. Wood or glass fibres, clays, and other fillers are understood as falling within the scope of the term "particulate materials" which can be so premixed.

Where plastics materials are to be included, they may comprise thermoplastics or thermosetting plastics particles of various kinds alone or as blends with other plastics for example as follows:

| | |
|---|---|
| Acrylonitrile-butadiene-styrene | with Polyvincylchloride |
| Acrylonitrile-butadiene-styrene | with Polypropylene |

-continued

| | |
|---|---|
| Polyphenylene ether | with Polypropylene |
| Polyphenylene ether | with Polyamide |
| Polycarbonate | with Polyalkyleneterephthalate |
| Polycarbonate | with Polyestercarbonate |
| Polyvinylchloride | with Phenolformaldehyde |
| Polypropylene | with Lignin |

Where such polymers are incorporated alone or as blends, finely powdered antioxidants may be adhered to them by premixing as above described, together with, if desired, pigments such as carbon black or titanium dioxide or fillers such as calcium carbonate. Alternatively, or in addition, one of two particulate polymeric plastics to be included may be first ground to a smaller dimension and then adhered to the other plastic by premixing as above described.

As referred to earlier the particulate material can be the fibres themselves and thus the invention can be used in a paper making process by mixing the fine powder, again, for example a colouring pigment, with the fibres, for example, cellulose fibres in dry form and then using the mix to form an aqueous dispersion, laying this on a wire and forming a paper web in the usual manner.

The process can also be used if more than one kind of fibre is employed in a web, the fine powders being dry mixed with one or more of the fibres to be used prior to forming the aqueous dispersion.

We claim:

1. A method of making a web of reinforced fibres containing in its interstices particles having a particle size of from 100 to 500 microns of at least one plastics material coated with at least one kind of powdered material, said powdered material having particle sizes of not more than 100 microns and being substantially finer than the particulate plastics material and selected from the group consisting of a pigment, an antioxidant and mixtures thereof, comprising the steps of:

mixing the plastics particles in a solid state and powdered material together in a substantially dry condition to cause the powdered material to coat the plastics particles, dispersing said coated plastics particles, together with the reinforcing fibres in water to form an aqueous dispersion, and draining the aqueous dispersion to form a web.

2. A method as claimed in claim 1 in which the particulate plastics materials are selected from the group of thermoplastic and thermosetting polymers.

3. A method as claimed in claim 1 in which at least one of the powdered materials is a pigment.

4. A method as claimed in claim 3 in which the pigment is selected from the group consisting of carbon black and titanium dioxide.

5. A method as claimed in claim 1 in which the fibres are glass fibres.

6. A method as claimed in claim 1 in which mixing is effected in a mixer of the high shear type.

7. A method as claimed in claim 1, wherein the aqueous dispersion is foamed.

8. A method as claimed in claim 1, wherein at least one of the powdered materials is an antioxidant for one of the plastics materials.

9. A fibrous web made according to the method set forth in claim 1, said web comprising a matrix of reinforcing fibers having in the interstices thereof particles of at least one plastics material each coated with at least one powdered material.

* * * * *